US006398391B1

(12) United States Patent
Huang

(10) Patent No.: US 6,398,391 B1
(45) Date of Patent: Jun. 4, 2002

(54) PLUNGER ROD TYPE GARDEN LAMPPOST FOR OUTDOOR USE

(76) Inventor: Ming-Shien Huang, No. 2, Lane 65, Cheng Kong Road, Hsinchu City (TW)

( * ) Notice: Subject to any disclaimer, the term of this patent is extended or adjusted under 35 U.S.C. 154(b) by 0 days.

(21) Appl. No.: 09/612,448

(22) Filed: Jul. 7, 2000

(51) Int. Cl.[7] ..... F21S 13/10
(52) U.S. Cl. ..... 362/431; 362/267; 362/414
(58) Field of Search ..... 362/431, 353, 362/360, 437, 249, 391, 806, 267, 410, 411, 414

(56) References Cited

U.S. PATENT DOCUMENTS 5,649,760 A * 7/1997 Beadle ..... 362/267
5,738,435 A * 4/1998 Lin et al. ..... 36/249
6,135,623 A * 10/2000 Lin ..... 362/431

* cited by examiner

*Primary Examiner*—Stephen Husar
*Assistant Examiner*—Guiyoung Lee
(74) *Attorney, Agent, or Firm*—Rosenberg, Klein & Lee

(57) ABSTRACT

An improved garden lamppost of the plunger rod type for outdoor use is disclosed. The present invention primarily uses the C type light bulbs mounted on the top of the lamppost to seal the top opening of the pole body to prevent the penetration of rain water. Thus it is more suitable for outdoor use. Further, the larger C type light bulbs also provide better illumination in comparison with a prior art garden lamp and so it has more practical value in use.

1 Claim, 4 Drawing Sheets

PLUNGER ROD TYPE GARDEN LAMPPOST FOR OUTDOOR USE

BACKGROUND OF THE INVENTION

A conventional garden lamps, as shown in FIG. 1, is composed of several thin electrical conductive wires (11) extending through the hollow interior of a lamppost (1) and connected in series to a plurality of small light bulbs (12). The lamppost is farther mounted in a garden or sports field for outdoor use. Problems rose due to the penetration of rainwater from the top opening of lampposts, which often causes electrical conductive wires (2) short circuited in poles. Thus it is desirable to have improvements made on the conventional structure.

The present invention primarily provides an improved lamppost structure that has a close fit with C type light bulbs to achieve a waterproof effect while providing better decoration and illumination. Now the present invention will be described in detail with reference to the accompanying drawings.

BRIEF DESCRIPTION OF THE ACCOMPANYING DRAWINGS

DETAILED DESCRIPTION OF THE INVENTION

Figure 1:
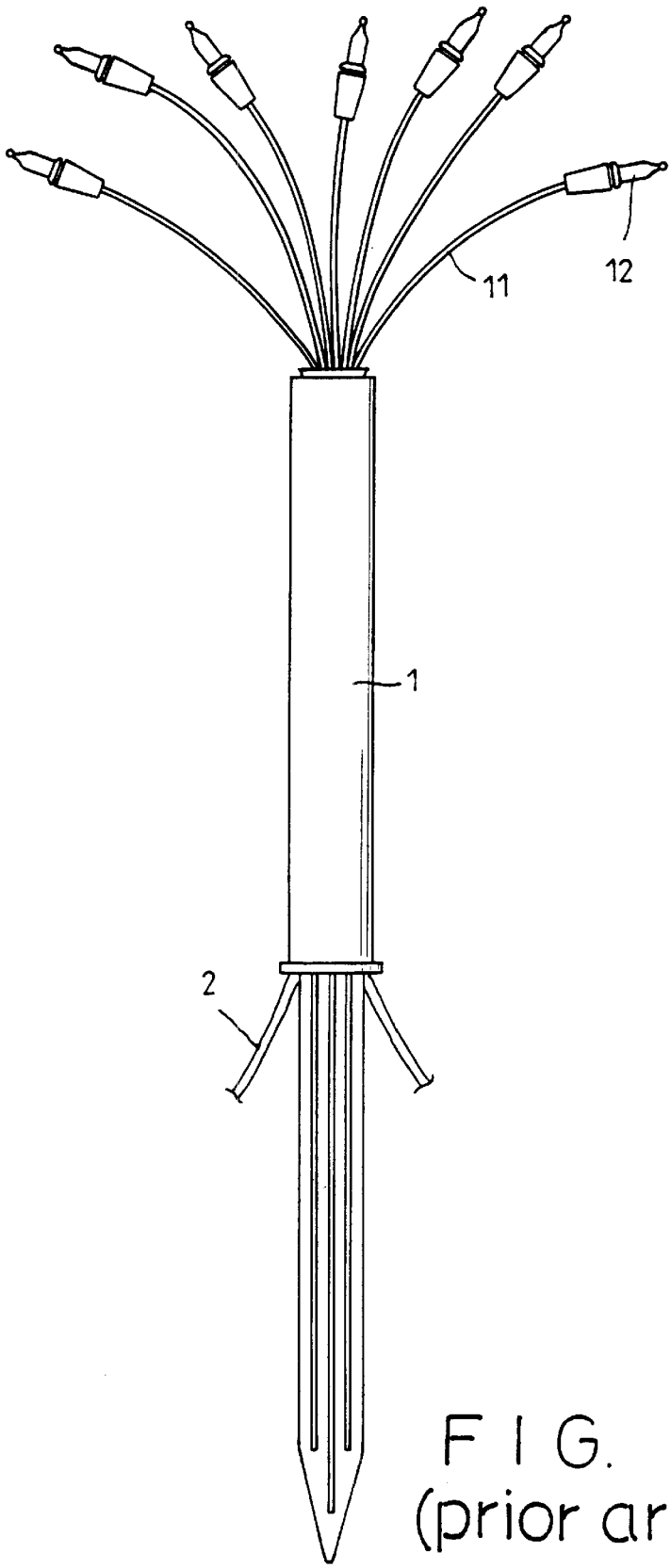
FIG. 1 (prior art)
FIG. 1 is a plan view showing a prior art plunger rod type garden lamppost.
Figure 2:
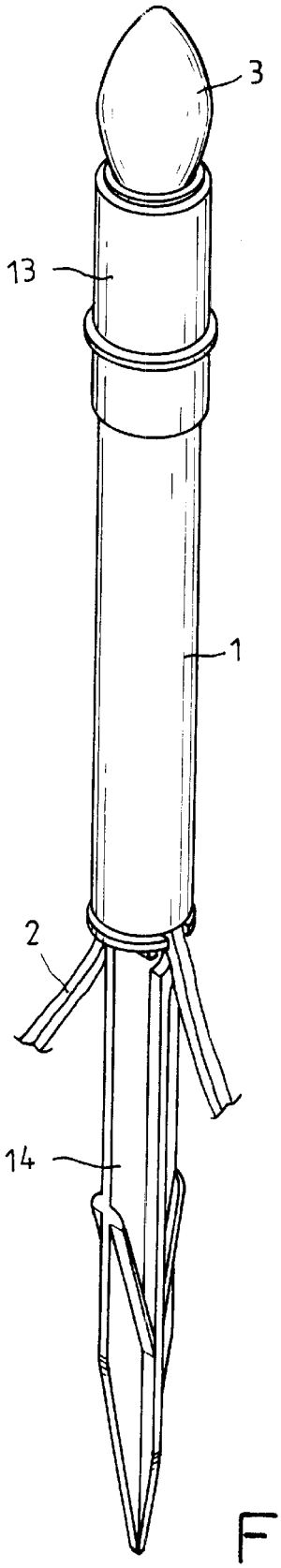
FIG. 2 is a perspective view showing an embodiment of a garden lamppost of the plunger rod type according to the invention.
Figure 3:
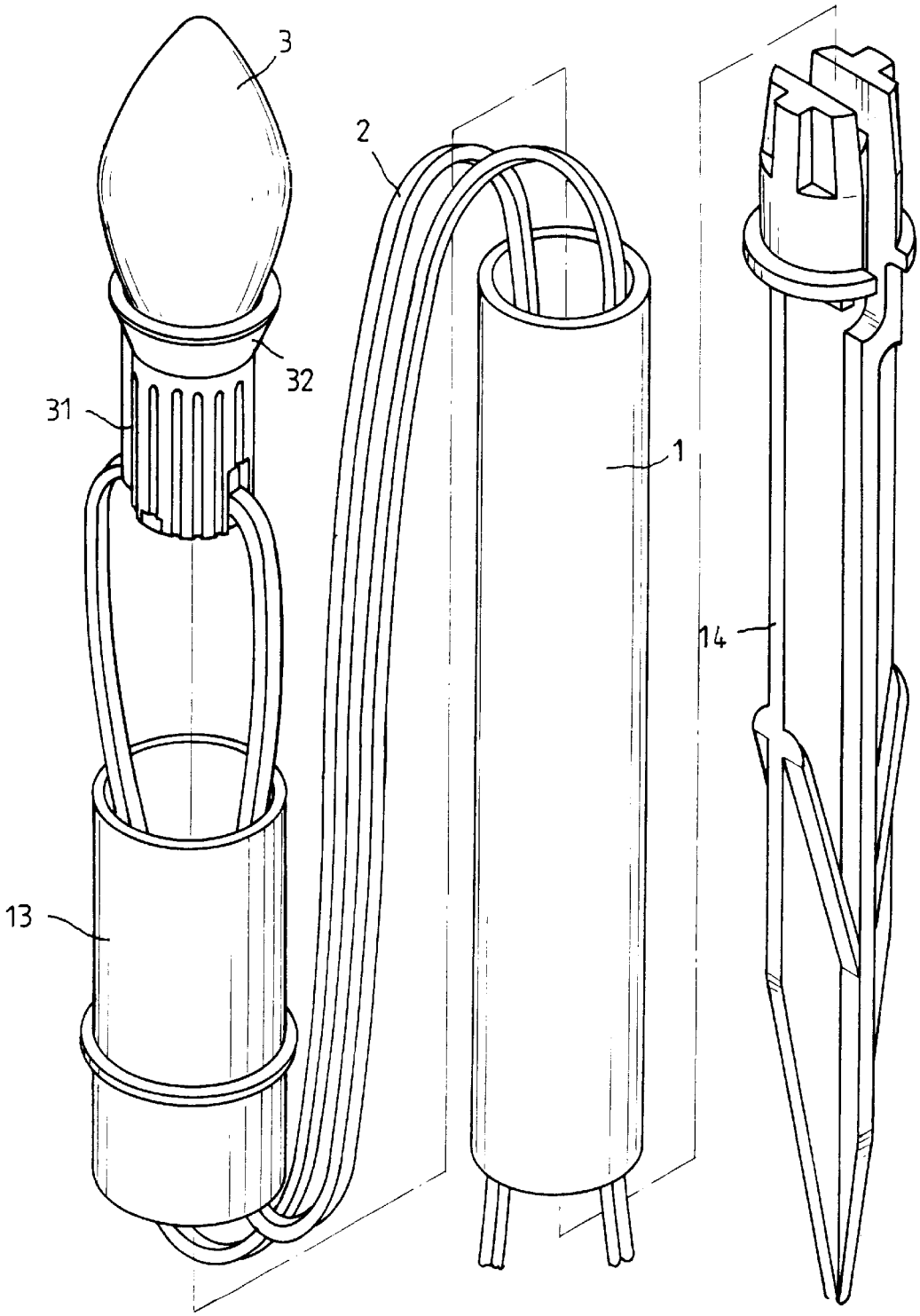
FIG. 3 is an exploded view showing the garden lamppost of FIG. 1.

Referring to FIGS. 2 and 3, a garden lamppost of the plunger rod type according to the invention comprises a pole body (1) associated with an upper receiving tube portion (13) and a lower footing portion (14). Electrical conductive wires (2) are routed through the hollow pole body (1) to provide power to the lamp. By means of the pointed lower end of the footing portion (14), the lamppost can be mounted on the ground. The present invention is further characterized by a socket (31) provided on the top of the receiving portion (13) for a C type light bulb. The socket (31) has such a conical portion (32) configured to fit for a light bulb so that after mounted on the conical portion (32) the C type light bulb can close the top end opening of the receiving tube portion (13) to minimize the penetration of rainwater.

Figure 4:
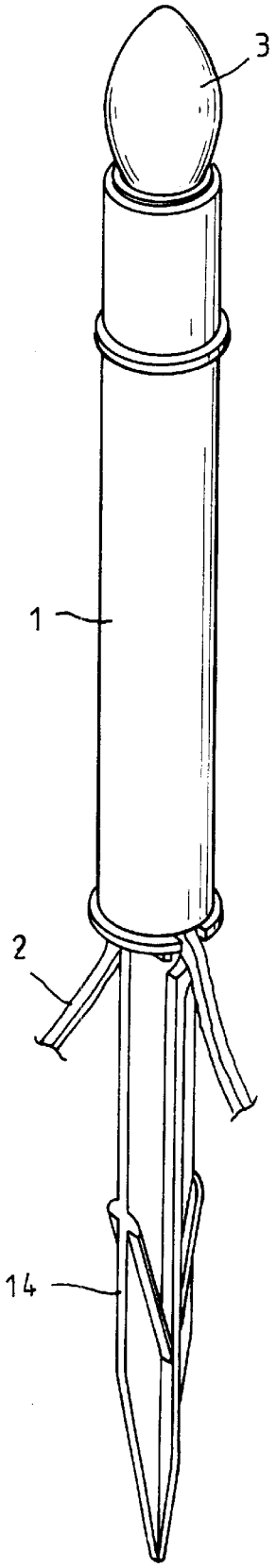
FIG. 4 shows a variant of the garden lamp of the plunger rod type according to the invention.

Moreover, the invention uses a C type light bulb (3) as an illuminating source that has a larger body and provides better illumination. Thus the invention gives a better decorative effect than a prior art garden lamp. FIG. 4 shows a variant of the invention in which the socket is directly provided on the top of the pole body (1) for receiving a C type light bulb (3). The variant can reach the same advantages as the described above. In brief, the present invention provides a garden lamppost with a different construction for outdoor use that has a waterproof property and a better decorative effect. It has practical value in the field and so meets the requirements of a patent grant.

What is claimed is:

1. An outdoor plunger rod type lamppost comprising:

a substantially tubular pole body defining an axially extended bore, said pole body having opposing upper receiving and lower footing portions, said upper receiving portion describing an annular top end opening communicating with said bore;

a socket for a C type light bulb extending coaxiilly into said upper receiving portion of said pole body, said socket including an upper conical portion having an outer surface engaging in substantially scaled manner an inner periphery of said upper receiving portion top end opening; and, an electrical conductor coupled to said socket, said electrical conductor extending through said bore of said pole body.

* * * * *